United States Patent [19]

Kosonen et al.

[11] 4,412,373

[45] Nov. 1, 1983

[54] METHOD OF MANUFACTURING A THIN COPPER PLATE WITH FLOW CONDUITS

[75] Inventors: Ahti Kosonen; Mauri Palmu, both of Pori, Finland

[73] Assignee: Outokumpu Oy, Helsinki, Finland

[21] Appl. No.: 219,979

[22] Filed: Dec. 24, 1980

[30] Foreign Application Priority Data

Dec. 28, 1979 [FI] Finland ..... 794087

[51] Int. Cl.[3] ..... B21D 53/04; B21P 15/26

[52] U.S. Cl. ..... 29/157.3 V; 29/527.7; 29/421 R; 72/367; 72/368

[58] Field of Search ..... 72/367, 368, 206; 29/157.3 V, 527.7, 421 R

[56] References Cited

U.S. PATENT DOCUMENTS

| | | | |
|---|---|---|---|
| 2,190,494 | 2/1940 | Templin | 29/157.3 V |
| 2,375,334 | 5/1945 | Valyi et al. | 29/157.3 V |
| 2,983,994 | 5/1961 | Johnson | 29/157.3 V |
| 3,010,200 | 11/1961 | Wilkins | 29/157.3 V |
| 3,036,369 | 5/1962 | Wilkins | 29/157.3 V |
| 3,354,530 | 11/1967 | Middleton | 29/157.3 V |
| 3,465,406 | 9/1969 | Myers | 29/157.3 V |
| 4,083,093 | 4/1978 | Chertok | 29/157.3 V |

FOREIGN PATENT DOCUMENTS

| | | | |
|---|---|---|---|
| 840584 | 7/1960 | United Kingdom | 29/157.3 V |

*Primary Examiner*—Lowell A. Larson

*Attorney, Agent, or Firm*—Brooks, Haidt, Haffner & Delahunty

[57] ABSTRACT

A method of manufacturing a thin plate or band from copper or a copper alloy is disclosed, the plate or band having flow conduits parallel to its plane, in which a thicker copper plate billet, which also has flow conduits parallel to its plane and the total wall thickness of which, as measured in a direction perpendicular to the plane of the plate, is equal to the thickness of the plate on both sides of the flow conduit, is cold worked to its final material thickness, whereafter the flow conduit flattened during the rolling is opened by means of pressure produced inside it.

5 Claims, 5 Drawing Figures

Fig. 1A
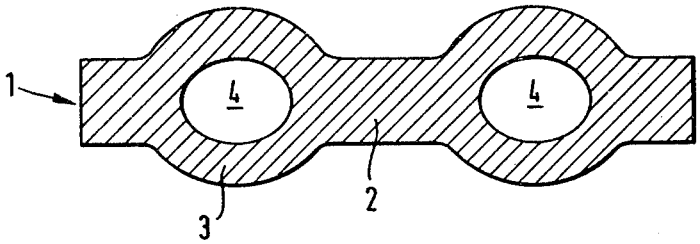
Fig. 1B
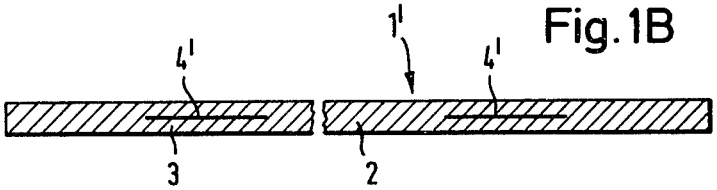
Fig. 1C
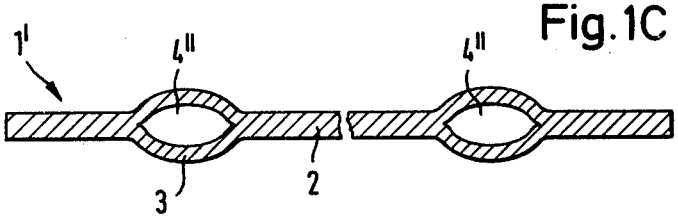
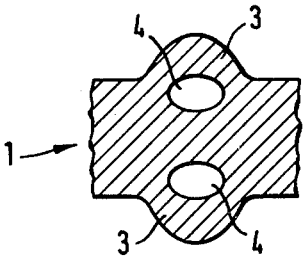
Fig. 2

METHOD OF MANUFACTURING A THIN COPPER PLATE WITH FLOW CONDUITS

BACKGROUND OF THE INVENTION

The present invention relates to a method of manufacturing a thin copper plate with at least one flow conduit parallel to its plane.

In heat exchangers and the like, it is desirable to obtain a maximal surface area of the plate which yields or receives heat. At the same time, it is desirable to obtain maximum conduction of heat from the heat exchanger fluid to the flanges or ribs which increase the surface area. It is known that copper and its alloys are the best heat conductors in technical applications, and for this reason they are used whenever financially possible. Rib tubes made of copper in boilers, and automobile radiators made of copper alloys, are examples of applications in which copper metals have proved their superiority over other metals. The advantageous properties of copper also include its high resistance to corrosion in comparison with aluminum, for example.

When it is necessary either to heat or to cool large surfaces, the fixing of tubes for conveying fluids to the surfaces in question complicates the use of copper metals. In such cases the fluid-conveying tubes are fixed to the plates either by welding or by bracing, whereby the construction becomes expensive and the conduction of heat from the fluid to the plate is reduced owing to the small contact surface and the solder. In these cases the plates are often made of aluminum, and then the required fluid tubes can be made by fitting graphite in the area of the desired flow conduits between the two aluminum plates and by joining the aluminum plates by hot working, whereafter the flow conduits are opened by using pressure. Owing to the high hot-working temperature, such a method is impossible with copper metals and would in practice be very expensive.

The object of the present invention is thus to produce a simpler and less expensive method than previously for producing a thin copper plate with flow conduits parallel to its plane. When necessary, separate inner tubes can be installed in the opened tubular conduits to improve corrosion resistance or for some other practical reason.

SUMMARY OF THE INVENTION

According to the invention a thin plate or band having at least one flow conduit parallel to its plane is manufactured from copper or copper alloys by cold working a thicker copper plate billet, which also has at least one flow conduit parallel to its plane and the total wall thickness of which, as measured in a direction perpendicular to the plane of the plate, is preferably at least approximately equal to the thickness of the plate on both sides of the flow conduit, to the final material thickness of the billet, whereafter the flow conduit flattened during the rolling is opened by means of pressure produced inside it.

Using the method according to the present invention, enables producing from copper metal or alloy a plate or band having in its longitudinal direction, a suitable number of conduits for the fluid required in the heat exchanger. The manufacture is started by casting, by continuous-casting technique, a billet having one or several longitudinal conduits. Since by the continuous-casting method it is possible to manufacture relatively thin billets, as thin as 20 mm, the billet can easily be shaped by cold-working technique. Thereby the conduits produced during the casting are pressed together; however, the conduit surfaces pressed against each other remain in mechanical contact only, without becoming welded to each other. When the plate is of the desired thickness, the conduits are easily opened by using water pressure, for example. The result is a plate similar to the above-mentioned aluminum plate with its tubes, produced by hot working. For cold-working it is advantageous to arrange the initial casting so that the thickness reduction due to the working is equal in the area of the conduits and the "isthmuses" between the conduits.

By current casting techniques, it is possible to produce billets 700–800 mm wide, in which it is possible to form, for example, 4–5 conduits in the longitudinal direction. Furthermore, it is possible, if so desired, to position the conduits closer to one side of the plate, in which case, when the tubes are blown open, it is possible to obtain a plate which is smoother on one side, the tubes bulging out on the opposite side.

Such a plate has numerous applications in heat exchangers, but the said plate is especially suitable for solar cells, in which it has the following advantages over other solar-cell plates:

- transfer of heat from the plate to the tubes is considerably better than in plates in which the tubes have been fixed to the plate by some other method
- heat conductivity of copper is higher than that of aluminum, for example
- black surface produced on copper is known to be one of the best absorption surfaces
- the corrosion resistance properties of copper are more advantageous than those of, for example, aluminum or other metals, and the tubes departing from the cell are mostly copper tubes, in which case the same metals will not cause galvanic corrosion. Attempts have been made to eliminate this disadvantage in, for example, aluminum plates by installing copper tubes in the conduits of the plate, this method being awkward and expensive
- depending on the application of the heat-exchanger plate, separate inner tubes can be installed in the opened conduits.

DESCRIPTION OF THE INVENTION

FIG. 1A depicts a cross-sectional end view of a billet used for a preferred embodiment of the invention, FIG. 1B depicts the same cross-sectional end view of the billet of FIG. 1A, after rolling, FIG. 1C depicts a cross-sectional end view of the rolled plate of FIG. 1B, after the conduits have been blown open, FIG. 2 depicts a cross sectional partial view of an alternative billet to be used for the method according to the invention, and FIG. 3 depicts a cross-sectional end view of an alternative billet wherein the conduits are closer to one surface of the billet.

DESCRIPTION OF THE PREFERRED EMBODIMENTS

Figure 3:
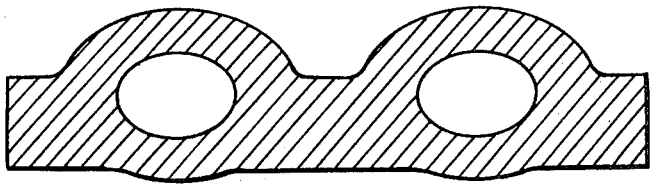

In FIG. 1A, the copper plate or copper alloy plate produced by the continuous-casting method is indicated by reference numeral 1, and it has two parallel flow conduits 4 having an oval cross section. The flow-conduit wall is indicated by 3 and the "isthmus" between the conduits is indicated by 2. The thickness of the wall 3 of the flow channel 4 is preferably one-half of the material thickness of the billet 1, as measured perpendicularly to its surface, the thickness reduction due to the working being equal in the areas of the conduits 4 and the isthmus 2 between the conduits.

FIG. 1B depicts the rolled billet 1'. During the rolling, the billet 1 depicted in FIG. 1A is flattened and lengthened (if necessary, it widens when rolled transversally). At the same time the flow conduits in the billet are flattened, as shown at 4', but their opposite surfaces are not welded together.

Finally, the flattened conduits 4' are blown open, whereby the thin copper or copper-alloy plate 1' with flow conduits 4", depicted in FIG. 1C, is obtained.

FIG. 2 depicts an alternative billet, which has two flow conduits 4, one on top of the other as seen in the direction perpendicular to the surface of the billet. Thus the total thickness of material, as seen perpendicular to the surface of the billet 1, is the same in the area of the openings and on both sides of the openings 4, so that the thickness reduction due to the working is equal in the area of the openings 4 and on both their sides.

The thickness of the billet depicted in FIG. 1A is preferably 15–20 mm, and the thickness of the thin plate depicted in FIG. 1C is preferably 0.6–1 mm. In the billets depicted in FIGS. 1A and 2, the conduits have an oval cross-sectional shape, but it is evident that the conduits have some other shape as well, for example, round, rhombic, etc.

Also, the conduits need not necessarily be in the center of the billet 1 as shown in FIG. 1A, but they can be closer to one surface of the billet, in which case one surface of the rolled plate with the conduits blown open is somewhat smoother than the opposite surface.

EXAMPLES

Cu-DLP band 0.6 mm thick and 250 mm wide was manufactured by applying the method according to the invention. Conduits (2 of them) having an almond-shaped cross-section were opened in the band by using air pressure of 1 N/mm$^2$, the wall thickness of the conduits being 0.3 mm, for example according to the following manufacturing instructions:

1.

Casting of a profiled billet, with the cross section shown in the reference figure, by continuous-casting techniques to cross sectional dimensions of 20 mm×250 mm: maximum thickness at openings 38 mm and wall thickness 10 mm, principal dimensions of the conduits in the billet being 18 mm (height) and 40 mm (width).

Cold rolling of the cast billet to 0.6 mm without intermediate annealing.

Opening of the tube conduits by compressed air (1 N/mm$^2$), using a suitable opening tool and an air nozzle, with the opposite end of the plate closed by pressing.

2.

Casting of a profiled billet according to the previous example.

Lubrication of the openings in the casting by using a rolling emulsion.

Cold rolling to a thickness of 0.67 mm.

Soft-annealing in a Strand Annealing Furnace.

Cold rolling to a thickness of 0.6 mm.

Opening of the tube conduits as in the previous example.

Plates according to the example have also been black chromium plated before the opening of the conduits.

What is claimed is:

1. A method of manufacturing a generally planar thin plate or band of copper or copper alloy having at least one flow conduit parallel to the plane of the plate or band consisting of the following steps:

(a) continuously casting a thick, profiled billet having an open flow conduit extending therethrough parallel to the plane thereof, said conduit having walls which, measured in a direction perpendicular to the plane of the billet have a total wall thickness at least equal to the thickness of the billet on both sides of the flow conduit;

(b) then cold working the profiled, continuously cast billet to reduce the thickness thereof whereby said conduit is flattened and the conduit walls are pressed into mechanical contact with each other without welding the conduit walls together, and (c) then opening the flow conduit by applying pressure to the inside of the conduit.

2. The method of claim 1 wherein the thick billet has a thickness of 15 to 20 mm, which is reduced by said cold working to a thickness of 0.4 to 1 mm.

3. The method of claims 1 or 2 wherein the billet is continuously cast with flow conduits having oval cross sections.

4. The method of claim 1 in which the billet is continuously cast with flow conduits closer to one billet surface to produce a thin plate which is smoother on one side than the other by said cold working.

5. The method of claim 1 wherein said billet is continuously cast with a plurality of conduits arranged in a plane perpendicular to the plane of the billet.

* * * * *